US011387545B2

(12) United States Patent
Ai et al.

(10) Patent No.: US 11,387,545 B2
(45) Date of Patent: Jul. 12, 2022

(54) RADIATOR SUPPORT, RADIATOR AND BASE STATION ANTENNA

(71) Applicant: CommScope Technologies LLC, Hickory, NC (US)

(72) Inventors: Bin Ai, JiangSu (CN); Keyun Di, JiangSu (CN); PuLiang Tang, JiangSu (CN)

(73) Assignee: CommScope Technologies LLC, Hickory, NC (US)

( * ) Notice: Subject to any disclaimer, the term of this patent is extended or adjusted under 35 U.S.C. 154(b) by 78 days.

(21) Appl. No.: 17/082,824

(22) Filed: Oct. 28, 2020

(65) Prior Publication Data

US 2021/0151863 A1 May 20, 2021

(30) Foreign Application Priority Data

Nov. 18, 2019 (CN) ..... 201911124061.8

(51) Int. Cl.

| | |
|---|---|
| ***H01Q 1/24*** | (2006.01) |
| ***H01Q 9/16*** | (2006.01) |
| ***H01Q 21/26*** | (2006.01) |
| *H01Q 21/06* | (2006.01) |
| *H01Q 15/14* | (2006.01) |
| *H01Q 21/28* | (2006.01) |

(52) U.S. Cl.

CPC ..... *H01Q 1/246* (2013.01); *H01Q 9/16* (2013.01); *H01Q 21/26* (2013.01); *H01Q 15/14* (2013.01); *H01Q 21/062* (2013.01); *H01Q 21/28* (2013.01)

(58) Field of Classification Search

CPC ..... H01Q 1/246; H01Q 9/16; H01Q 21/26; H01Q 15/14; H01Q 21/28; H01Q 21/062

See application file for complete search history.

(56) References Cited

U.S. PATENT DOCUMENTS

2020/0185838 A1* 6/2020 Li ..... H01Q 5/42

* cited by examiner

*Primary Examiner* — Joseph J Lauture

(74) *Attorney, Agent, or Firm* — Myers Bigel, P.A.

(57) ABSTRACT

The present invention relates to a radiator support for a base station antenna. The radiator support includes a first support part and a second support part that are separate from each other. The first support part is configured to be mounted to extend upwardly from a reflector plate, to extend in part of a height of the feeding stalk, and to bear radially the feeding stalk so as to prevent roll-over of the feeding stalk. The second support part is configured to be mounted adjacent a distal end of the feeding stalk facing away from the reflector plate, and to receive a radiating element. The present invention also relates to a radiator having such radiator support, and a base station antenna having such a radiator. The radiator support according to the present invention has a simple structure, occupies a small structural space and has a favorable versatility.

23 Claims, 4 Drawing Sheets

RADIATOR SUPPORT, RADIATOR AND BASE STATION ANTENNA

RELATED APPLICATION

The present application claims priority to and the benefit of Chinese Patent Application No. 201911124061.8, filed Nov. 18, 2019, the content of which is hereby incorporated herein in its entirety.

TECHNICAL FIELD

The present disclosure relates to the field of wireless communications, and more particularly to a radiator support for a base station antenna, a radiator having such a radiator support, and a base station antenna having such a radiator.

BACKGROUND ART

Mobile communication networks include many base stations, each of which may include one or more base station antennas for receiving and transmitting radio frequency (RF) signals. A single base station antenna may include many radiators, which may also be referred to as antenna elements. Nowadays, mobile phone operators often require base station antennas to operate in two, three or more frequency bands and typically have strict limits on the size of the base station antennas. It may therefore be challenging to meet both the functional and dimensional requirements required by mobile phone operators for base station antenna designs.

Especially in the 5G era, the number of antenna elements that are provided per unit area on a reflector plate is increasing in order to provide service in new frequency bands and/or to increase capacity. In some known multi-band base station antennas, each low-band radiator has a respective one-piece radiator support that takes up a significant amount of space on the reflector plate. This known radiator support has a plurality of support arms that are distributed in a circumferential direction. Each support arm extends radially outwards from a central region of the support, and extends at an angle in a height direction so that the distance between each support arm and the reflector plate increases with increasing distance from the central region.

SUMMARY

Embodiments of the present invention provide a radiator support for a base station antenna, which has improved versatility and which is improved in the aspect of structural space.

Embodiments of the present invention provide a radiator having such a radiator support, and a base station antenna having such a radiator.

A first aspect of the present invention provides a radiator support for a base station antenna. The radiator support includes a first support part and a second support part that are separate from each other. The first support part is configured to be mounted to extend upwardly from the reflector plate, to extend in part of a height of the feeding stalk and to support radially the feeding stalk so as to prevent roll-over of the feeding stalk. The second support part is configured to be mounted adjacent a distal end of the feeding stalk facing away from the reflector plate, and to receive a radiating element.

The radiator support according to embodiments of the present invention can have a simple structure and a compact size and may be widely versatile and cost-effective.

In some embodiments, the first support part may be one-piece or may be constructed from a plurality of members.

In some embodiments, the second support part may be one-piece or may be constructed from a plurality of members.

In some embodiments, the first support part is configured to support the feeding stalk in a circumferential direction. Therefore, the feeding stalk may be prevented from torsion.

In some embodiments, the feeding stalk may include two printed circuit board members arranged in a crossed manner. The two printed circuit board members can form four legs extending radially.

In some embodiments, the feeding stalk may be constructed as an integral member, for example made by injection molding. Conductors may be embedded in an injection-molded body or printed wires may be applied on the surface of the injection-molded body.

In some embodiments, the first support part may include a plurality of bearing portions configured to bear the four legs.

In some embodiments, the first support part may include four bearing portions, each of which can be configured to bear one of the four legs.

In some embodiments, the plurality of bearing portions may include four receiving portions, each of which can be configured to clamp a respective one of the legs from a radial exterior of the leg and to bear radially the leg.

In some embodiments, each receiving portion may respectively have a U-shaped cross section, and the four receiving portions may be integrally connected to each other in a circumferential direction.

In some embodiments, the first support part may have a plurality of securing locations which can be distributed in a circumferential direction.

In some embodiments, the plurality of securing locations can include two flanges that are opposedly arranged for receiving fastening elements and can include two snap-fit elements.

In some embodiments, the second support part may include a plurality of clamping portions, each of which can be configured to clamp a respective one of the legs from a radial exterior of the respective leg.

In some embodiments, the number of the clamping portions may be two, three or four.

In some embodiments, the second support part may include a first annular member that can connect the plurality of clamping portions to each other in a circumferential direction.

In some embodiments, at least one of the plurality of clamping portions may have a snap-fit element for forming a snap-fit connection with the feeding stalk.

In some embodiments, the second support part may include a second annular member for receiving the radiating element.

In some embodiments, the second support part may include a plurality of protrusions projecting radially outward from the second annular member. A first of the protrusions can have a securing structure for securing the radiating element.

In some embodiments, the number of the protrusions may be four. The protrusions can be distributed in a circumferential direction, and each of the protrusions can include the securing structure.

In some embodiments, the second annular member and the plurality of protrusions may form a planar support surface.

In some embodiments, the support surface can be configured to bear in a planar manner the radiating element.

In some embodiments, the first protrusion may have two limbs and a bottom connecting the two limbs.

In some embodiments, the two limbs may project from the bottom towards the reflector plate.

In some embodiments, a snap-fit element for a snap-fit connection with the radiating element may be provided on at least one of the two limbs.

In some embodiments, in a projection along a longitudinal direction, an outer contour of the first annular member may be within an inner contour of the second annular member.

In some embodiments, viewed along a longitudinal direction, the first annular member may be closer to the first support part than the second annular member.

In some embodiments, the first annular member and the second annular member may be connected by a plurality of connecting portions that are distributed in a circumferential direction.

In some embodiments, the connecting portions may be radial extensions of the respective clamping portions.

In some embodiments, the first support part may be constructed to be substantially cylindrical.

In some embodiments, the second support part may be constructed to be flat.

In some embodiments, the second support part can have a height dimension that is less than or equal to ⅓ of a maximum radial dimension, for example less than or equal to ¼ or ⅕ of the maximum radial dimension.

In some embodiments, the second annular member and the protrusions may be constructed to be substantially planar.

A second aspect of the present invention proposes a radiator for a base station antenna that includes a feeding stalk and a radiating element. The feeding stalk can be configured to be mounted to extend upwardly from a reflector plate and to feed the radiating element. The radiator includes a radiator support for a base station antenna according to the first aspect of the present invention. A first support part of the radiator support extends for part of a height of the feeding stalk, and radially supports the feeding stalk so as to prevent roll-over of the feeding stalk; and a second support part of the radiator support is mounted adjacent a distal end of the feeding stalk facing away from the reflector plate, and receives the radiating element.

In some embodiments, the feeding stalk may include two printed circuit board members arranged in a crossed manner. The two printed circuit board members form four radially-extending legs, each of which may have a step on an end facing away from the reflector plate such that the one-piece radiating element may be bear axially on the step.

In some embodiments, at least one of the four legs may have a hole for a snap-fit connection with the second support part.

In some embodiments, the radiating element may include dipoles arranged in a crossed manner, wherein each of the dipoles includes a pair of dipole arms.

A third aspect of the present invention proposes a multi-band base station antenna with an array of high-band radiators and an array of low-band radiators mounted on a reflector plate. The low-band radiators are radiators for a base station antenna according to the second aspect of the present invention. About or around one of the low-band radiators, a plurality of high-band radiators can be provided adjacent the feeding stalk of the one low-band radiator.

It should be noted here that various technical features recited in the present application may be arbitrarily combined with each other as long as they are not contradictory to one another. All the technically feasible combinations of features pertain to the technical contents described in the present application. In addition, the orientations mentioned in the present application, such as longitudinal, radial and circumferential directions, are defined with reference to a longitudinal center axis of the radiator in a state that the radiator is mounted on the reflector plate, unless otherwise stated.

BRIEF DESCRIPTION OF THE DRAWINGS

Next, the present invention will be illustrated in more detail by way of embodiments with reference to the accompanying drawings.

FIG. 4 is an exploded perspective view of a radiator support of the radiator of

FIG. 3.

DETAILED DESCRIPTION

Figure 1:
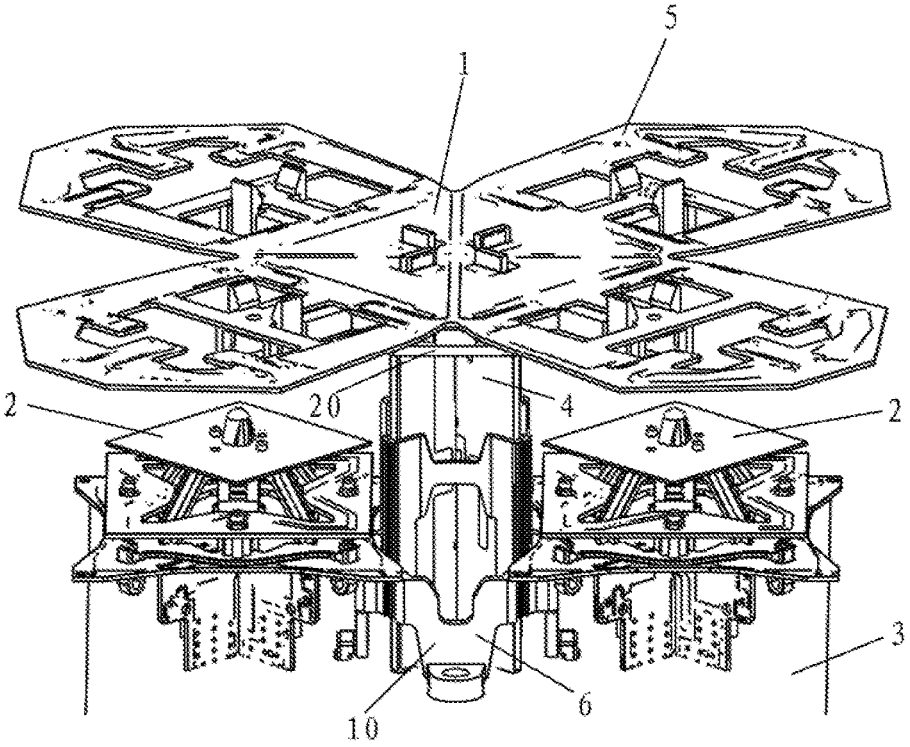
FIG. 1 is a partial perspective view of a multi-band base station antenna.

FIG. 1 is a partial perspective view of a multi-band base station antenna. A portion of a reflector plate 3 which may, for example, be made from aluminum, may be seen in FIG. 1. One or more feeding plates which may, for example, comprise a printed circuit board (see FIG. 2), may be provided on the reflector plate 3. An array of high-band radiators and an array of low-band radiators may be mounted on the reflector plate 3, and may be fed by the one or more feeding plates. These radiators may be received within a radome along with other antenna elements such as the reflector plate 3 and the feeding plates.

In FIG. 1, one low-band radiator 1 and two high-band radiators 2 are shown, where the low-band radiator 1 includes a feeding stalk 4, a radiating element 5, and a radiator support 6. The feeding stalk 4 is electrically connected to a feeding plate (FIG. 2) that is provided on the reflector plate 3 and is configured to pass RF signals between the radiating element 5 and other components of the antenna. Here, the radiating element 5 is integrally constructed from a printed circuit board and includes two dipoles that are arranged in a crossed manner, each of which includes a pair of opposed dipole arms. In other embodiments, not shown, the dipole arms may be constructed as separate members (e.g., separate sheet metal dipole arms). The two high-band radiators 2 are mounted on the reflector plate 3 adjacent the feeding stalk 4 of the low-band radiator 1. The high-band radiators 2 are located below the radiating element 5 as viewed in a longitudinal direction of the low-band radiator 1.

Note that while the radiators 1, 2 are depicted in the drawings and described herein as extending upwardly in the height direction from the reflector plate 3, in normal operation the base station antenna will be oriented so that the reflector plate 3 extends vertically and the radiators 1, 2 extend forwardly from the reflector plate 3.

One or more high-band radiators 2, for example three or four high-band radiators 2, may be provided around the feeding stalk 4 in a circumferential direction of the low-band radiator 1. In the present application, "high-band" and "low-band" are concepts that are relative to each other. In some embodiments, the "high-band" may be the 1695-2690 MHz frequency range or a portion thereof, and the "low band" may be the 617-960 MHz frequency range or a portion thereof.

Figure 2:
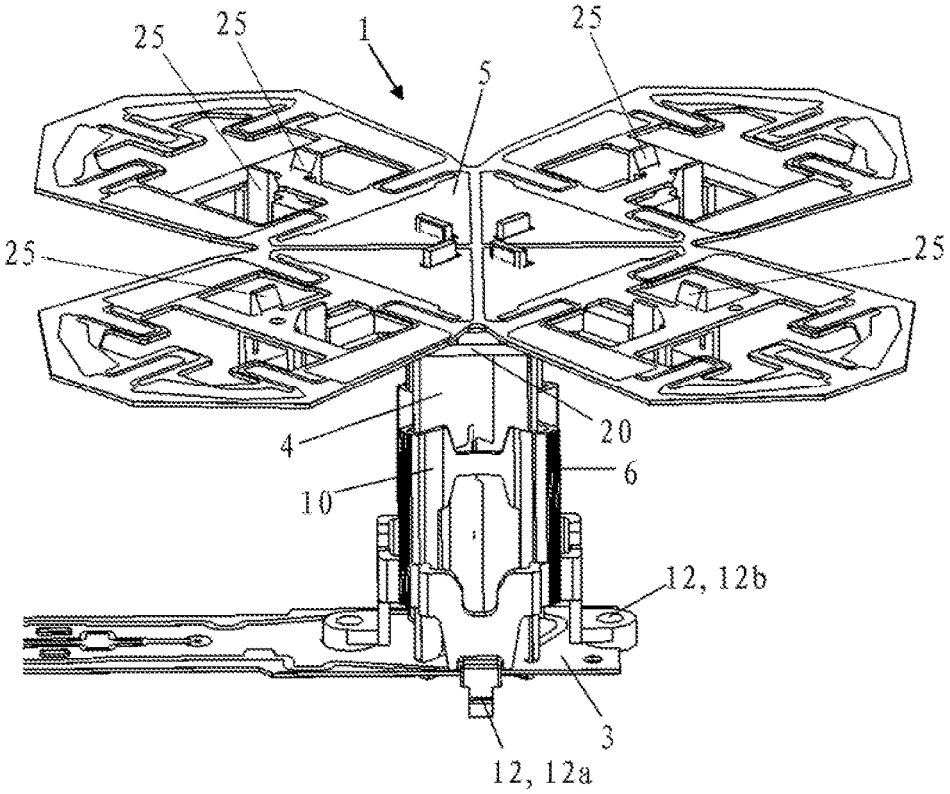
FIG. 2 is a perspective view of a radiator according to an embodiment of the present invention.
Figure 3:
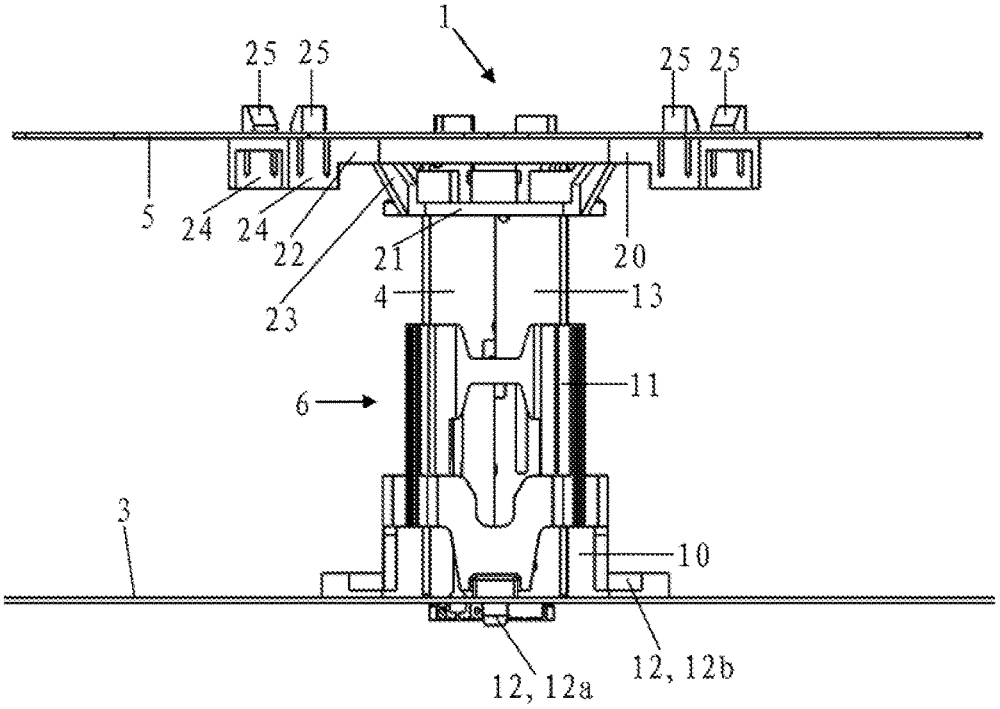
FIG. 3 is a side view of the radiator of FIG. 2.
Figure 4:
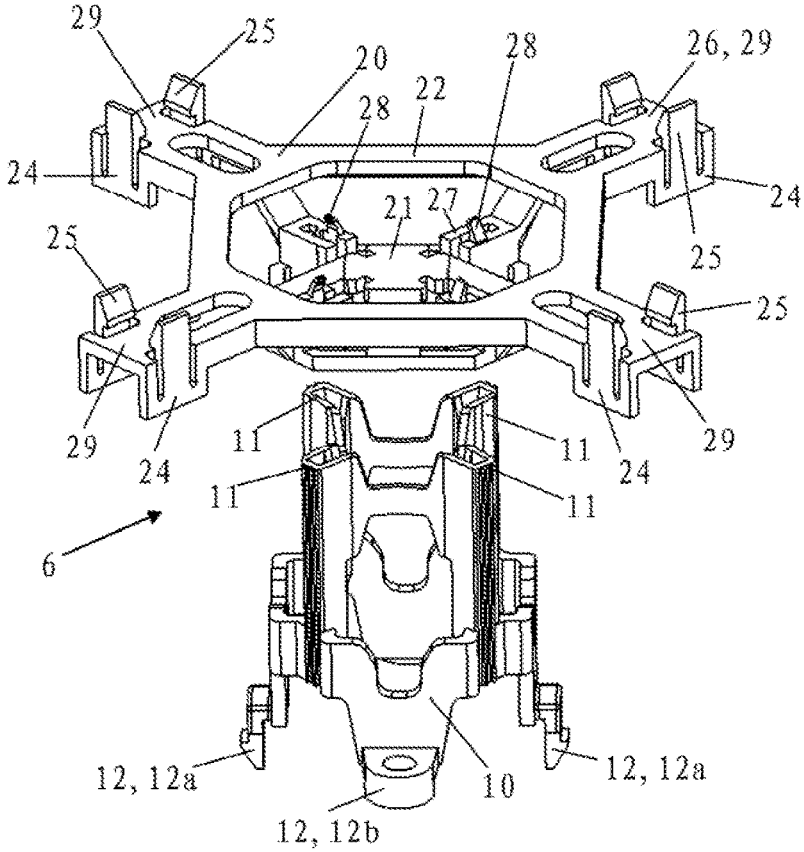
Figure 5:
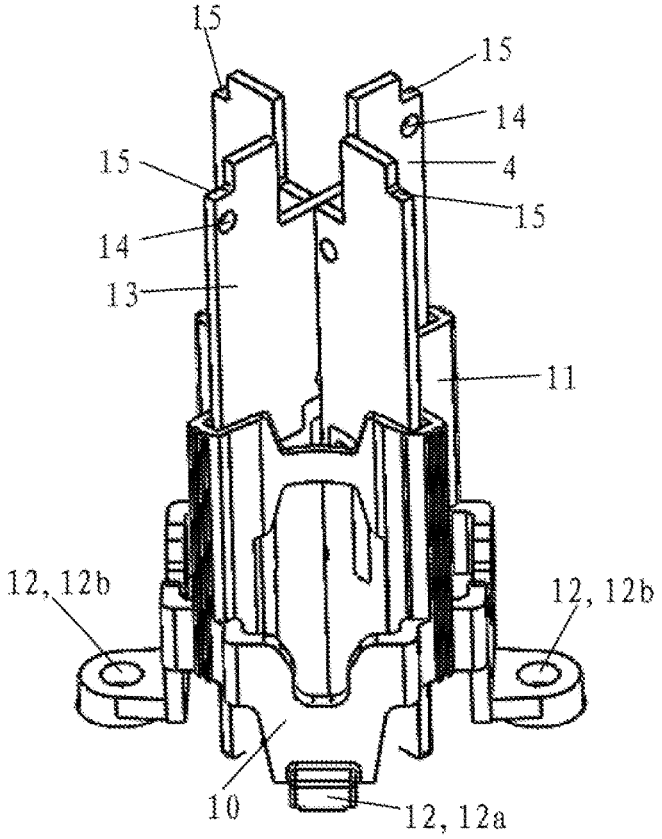
FIG. 5 is a perspective view of a first support part and a feeding stalk of the radiator of FIG. 3.
Figure 6:
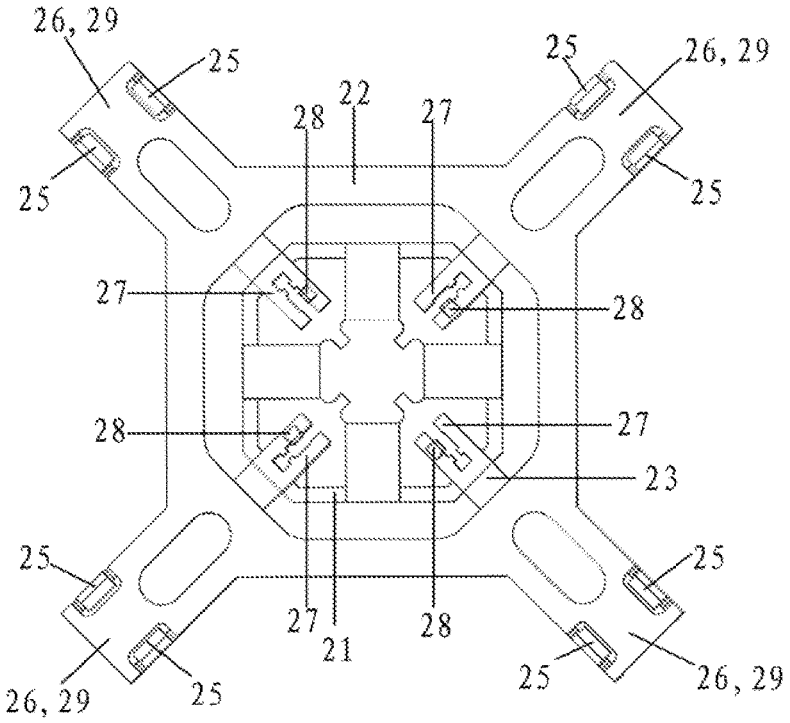
FIGS. 6 and 7 are a top view and a side view, respectively, of a second support part of the radiator support of FIG. 4.
Figure 7:
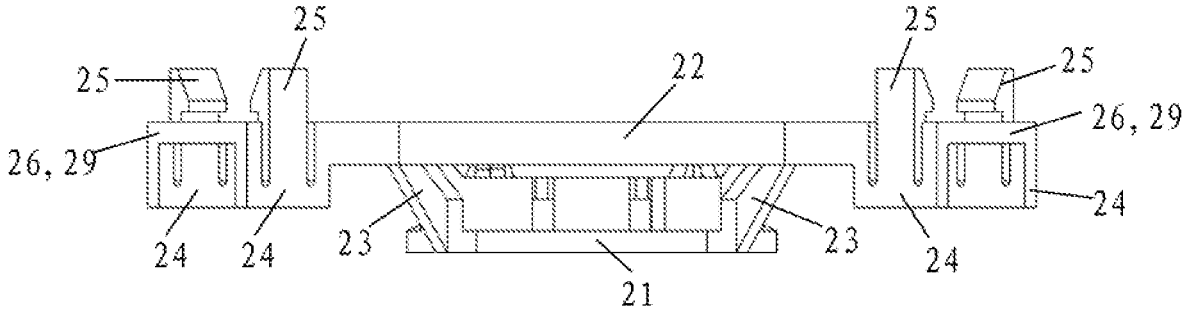
Figure 8:
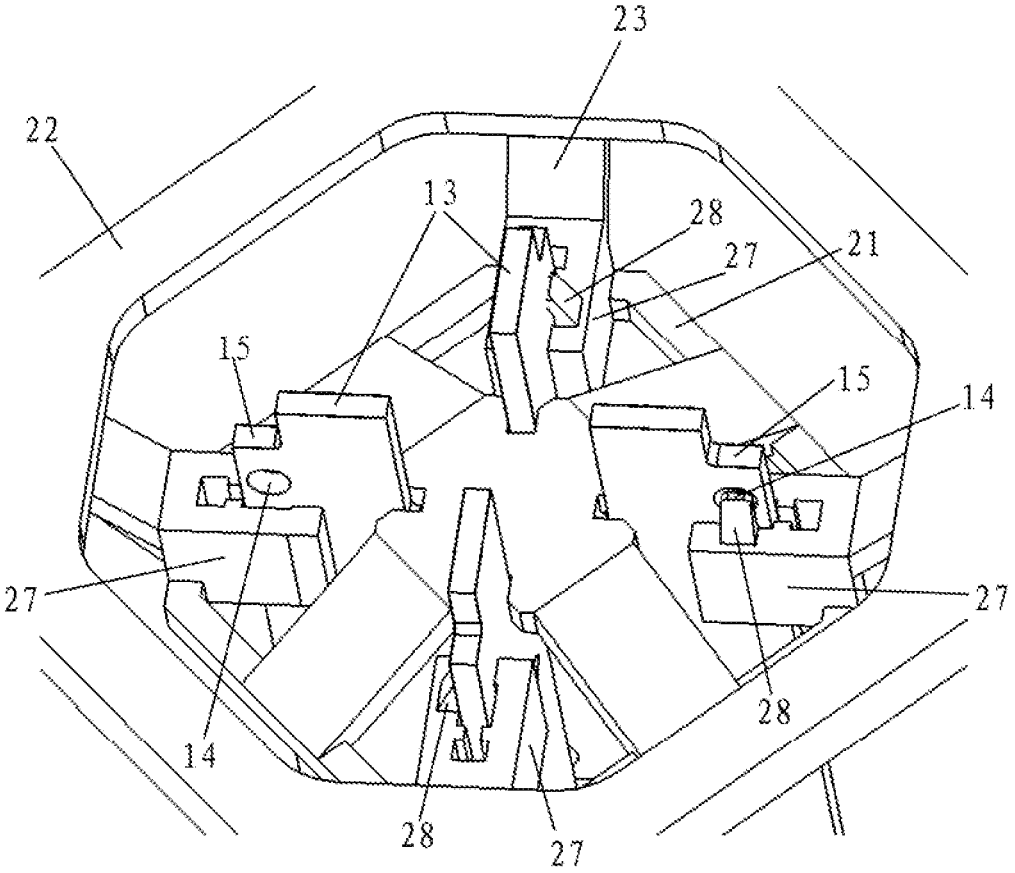
FIG. 8 is a partial perspective view of the second support part and the feeding stalk of the radiator of FIG. 3.

The low-band radiator 1 of FIG. 1 is illustrated in greater detail in FIGS. 2 and 3, with the two high-band radiators 2 omitted. FIG. 4 is a perspective view of the radiator support 6 of the radiator 1 of FIG. 3, FIG. 5 is a perspective view of a first support part 10 and the feeding stalk 4 of the radiator 1 of FIG. 3, FIGS. 6 and 7 are a top view and a side view, respectively, of a second support part 20 of the radiator support 6 of FIG. 4, and FIG. 8 is a partial perspective view of the second support part 20 and the feeding stalk 4 of the radiator of FIG. 3.

The radiator support 6 includes a first (lower) support part 10 and a second (upper) support part 20 that are separate from each other. The first support part 10 is configured to be mounted on the reflector plate 3, to extend part of a height of the feeding stalk 4 and to bear radially against the feeding stalk so as to prevent roll-over of the feeding stalk. The second support part 20 is configured to be mounted adjacent a distal end of the feeding stalk 4 facing away from the reflector plate 3, and to receive the radiating element 5. In the embodiments shown in the drawings, the first support part 10 and the second support part 20 are respective one-piece parts. However, it will be appreciated that in other embodiments one or both of the first and second support parts 10, 20 may include a plurality of respective members that are separate from one another, where the plurality of separate members may or may not be connected.

In the embodiment shown, the feeding stalk 4 includes two printed circuit board members that are arranged in a crossed manner, where the two printed circuit board members form four radially-extending legs 13, each of which may have a step 15 on an end facing away from the reflector plate 3 such that the one-piece radiating element 5 made from a printed circuit board may be mounted on the steps 15. Two of the four legs 13, which may be on the same or different printed circuit board members of the feeding stalk 4, have holes 14 for a snap-fit connection with the second support part 20.

In the embodiment shown, the first support part 10 includes four bearing portions 11, each of which is configured to receive a respective one of the legs 13 of the feeding stalk 4 and to clamp and/or bear against the respective leg 13 from a radial exterior of the leg 13. Each bearing portion 11 may have a U-shaped cross section, and the four bearing portions 11 may be integrally connected to each other in a circumferential direction of the radiator 1. By clamping the legs 13 by the respective U-shaped bearing portions, the two printed circuit board members of the feeding stalk 4 may have a stable relative position. In other embodiments, not shown, three bearing portions 11 may be provided for three of the four legs 13; or four bearing portions 11 may be provided, where three of the bearing portions 11 are constructed as shown in FIG. 4, while the fourth bearing portion only has a radial bearing function without clamping its corresponding leg 13.

The first support part 10 may have a plurality of securing locations 12 that are distributed in a circumferential direction of the radiator 1. The securing locations 12 may be used to mount the first support part 10 on the reflector plate 3 (e.g., either directly, or by mounting the first support part 10 to a feeding plate that is mounted to the reflector plate 3). The securing locations 12 may, for example, be two opposed flanges **12*b* that are configured for receiving fastening elements, and two snap-fit elements 12*a*, where the two flanges 12*b* and the two snap-fit elements 12*a* are distributed in a circumferential direction of the radiator 1. The snap-fit elements 12*a* may, for example, form a snap-fit connection with the reflector plate 3. The flanges 12*b*** may, for example, have holes for receiving push rivets.

In the embodiment shown, the second support part 20 includes four clamping portions 27, each of which is configured to clamp an upper portion of a respective one of the legs 13 from a radial exterior of the leg 13. The second support part 20 includes a first annular member 21 that connects the four clamping portions 27 to each other in a circumferential direction of the radiator 1. Each clamping portion 27 has a snap-fit element 28 for a snap-fit connection with the feeding stalk 4, where the snap-fit elements 28 may snap into corresponding holes 14 in the feeding stalk 4. This snap-fit connection may be effective uni-directionally, i.e., it may prevent the second support part 20 from being detached from the feeding stalk 4. Alternatively, his snap-fit connection may also be effective bi-directionally, i.e., it is not only possible to prevent the second support part 20 from being detached from the feeding stalk 4, but also possible to prevent the second support part 20 from further push on the feeding stalk 4 towards the first support part 10.

In the embodiment shown, the second support part 20 includes a second annular member 22 for receiving the radiating element 5, where the second annular member 22 is connected to the first annular member 21 by four connecting portions 23 that are distributed in a circumferential direction of the radiator 1. In a projection along a longitudinal direction (height direction) of the radiator 1, the outer contour of the first annular member 21 is within the inner contour of the second annular member 22, and the connecting portions 23 are radial extensions of the respective clamping portions 27. The first annular member 21 is closer to the first support part 10 than the second annular member 22, when viewed along the longitudinal direction of the radiator 1. The second support part 20 includes four protrusions 29 that project radially outward from the second annular member 22, each of which is configured to axially support one of the dipole arms of the radiating element 5 and has a securing structure for securing this dipole arm. The second annular member 22 and the four protrusions 29 may form a coplanar support surface on which the one-piece radiating element 5, which may comprise a printed circuit board, may rest in a planar manner. As shown in FIGS. 4, 6 and 7, each protrusion 29 has two limbs 24 and a bottom 26 connecting the two limbs 24. The two limbs 24 project from the bottom 26 towards the reflector plate 3, and respective snap-fit elements 25 for a snap-fit connection with the radiating element 5 are arranged on the two limbs 24. The radiating element 5 may be held on the support surface by these snap-fit elements 25. In some embodiments not shown, the securing structure may be realized by a screw and a screw hole, or may be realized by a cover for holding the radiating element 5 on the second support part 20, where the radiating element 5 is located between the second support part 20 and the cover which are snap-fit or are connected by fastening elements. Here, the number of connecting portions 23, clamping portions 27, and protrusions 29 are respectively exemplary. Their numbers may for example also be 1, 2, 3, 5, 6 and so on.

The radiators according to embodiments of the present invention may be assembled as follows:

Mounting the first support part 10 on the reflector plate 3;

Inserting the feeding stalk 4 into the first support part 10;

Connecting electrically the feeding stalk 4 to the feeding plate;

Mounting the radiating element 5 on the second support part 20; and

Mounting the second support part 20 with the radiating element 5 in an end area of the feeding stalk 4 facing away from the reflector plate 3.

The steps mentioned above may be performed in a logically reasonable order, rather than in a sequential order. Some steps may be performed in parallel or in an interchanging order.

In the radiator support 6 according to the present invention, the first support part 10 may be constructed to be substantially cylindrical, and the second support part 20 may be constructed to be flat. Compared to the one-piece radiator support in the prior art, the radiator support according to the present invention occupies a smaller structural space, so that it is possible to provide more space between the radiator support and the reflector plate for mounting high-band radiators which may be mounted to be closer to the feeding stalk of the low-band radiator in a radial direction without interfering with the radiator support of the low-band radiator. Therefore, it is possible to realize a higher density of radiators on the reflector plate 3. In addition, the two-part radiator support may be favorably suitable for radiators of different heights, and hence have improved versatility.

It will be understood that, the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to," when used herein, indicate that no intervening elements are present. Other words used to describe the relationship between elements should be interpreted in a like fashion (i.e., "between" versus "directly between", "attached" versus "directly attached," "adjacent" versus "directly adjacent", etc.).

Terms such as "top," "bottom," "upper," "lower," "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute a limit on the protection scope of the present invention. For those skilled in the art, modifications may be made on the basis of the above-described embodiments, and these modifications do not depart from the protection scope of the present invention.

What is claimed is:

1. A radiator support for a base station antenna comprising:

a first support part and a second support part that are separate from each other, wherein the first support part is configured to be mounted to extend upwardly from a reflector plate, to extend in part of a height of a feeding stalk, and to bear radially the feeding stalk so as to prevent roll-over of the feeding stalk, and wherein the second support part is configured to be mounted adjacent a distal end of the feeding stalk, away from the reflector plate and away from the first support part, and is also configured to receive a radiating element of a radiator associated with the feeding stalk to thereby support the radiating element.

2. The radiator support of claim 1, wherein the first support part has a lateral extension that is less than a lateral extension of the second support part, and wherein the first support part has a height that is less than a height of the second support part, and wherein the second support part is configured to receive spaced apart dipole arm segments of the radiating element to receive the radiating element and thereby support the radiating element.

3. The radiator support of claim 1, in combination with the feeding stalk, wherein the feeding stalk includes two printed circuit board members arranged in a crossed manner, wherein the two printed circuit board members form four radially extending legs, and the first support part includes a plurality of bearing portions for bearing the four legs.

4. The radiator support of claim 3, wherein the plurality of bearing portions comprise four receiving portions, each of which is configured to clamp a respective one of the legs from a radial exterior of the leg and bear radially the leg.

5. The radiator support of claim 4, wherein each receiving portion has a U-shaped cross section, and the four receiving portions are integrally connected to each other in a circumferential direction.

6. The radiator support of claim 3, wherein the second support part includes a plurality of clamping portions, each of which is configured to clamp a respective one of the legs from a radial exterior of the respective leg.

7. The radiator support of claim 6, wherein the plurality of clamping portions is four.

8. The radiator support of claim 6, wherein the second support part includes a first annular member that connects the plurality of clamping portions to each other in a circumferential direction.

9. The radiator support of claim 8, wherein the second support part includes a second annular member configured for receiving the radiating element, wherein in a projection along a longitudinal direction, an outer contour of the first annular member is within an inner contour of the second annular member, wherein viewed along the longitudinal direction, the first annular member is closer to the first support part than the second annular member, and wherein the first annular member and the second annular member are connected by a plurality of connecting portions that are distributed in a circumferential direction.

10. The radiator support of claim 9, wherein the connecting portions are radial extensions of the respective clamping portions.

11. The radiator support of claim 6, wherein at least one of the plurality of clamping portions has a snap-fit element for a snap-fit connection with the feeding stalk.

12. The radiator support of claim 1, wherein the first support part has a plurality of securing locations distributed in a circumferential direction.

13. The radiator support of claim 1, wherein the first support part comprises first and second flanges that are arranged opposite to each other and that are configured for receiving fastening elements, and wherein the first support part also comprises first and second snap-fit elements at locations that are spaced apart from the first and second flanges thereby providing different support features for mounting.

14. The radiator support for of claim 1, wherein the second support part includes a second annular member configured for receiving the radiating element.

15. The radiator support of claim 14, wherein the second support part includes a plurality of protrusions projecting radially outward from the second annular member, and wherein a first of the protrusions has a securing structure for securing the radiating element.

16. The radiator support of claim 15, wherein the plurality of protrusions is four, and wherein the protrusions are distributed in a circumferential direction, and each of the protrusions includes the securing structure.

17. The radiator support of claim 15, wherein the second annular member and the plurality of protrusions form a planar support surface which is configured to bear in a planar manner the radiating element.

18. The radiator support of claim 15, wherein the first protrusion has first and second limbs and a bottom connecting the first and second limbs, wherein the first and second limbs project from the bottom towards the reflector plate, and wherein a snap-fit element is provided on at least one of the first and second limbs, with the snap-fit element configured to connect to the radiating element.

19. A radiator for a base station antenna, comprising:

a feeding stalk and a radiating element, wherein the feeding stalk is configured to be mounted to extend upwardly from a reflector plate and to feed the radiating element; and a radiator support that includes a first support part and a second support part that are separate from each other, wherein the first support part extends for part of a height of the feeding stalk and bears radially the feeding stalk so as to prevent roll-over of the feeding stalk, and wherein the second support part is mounted adjacent a distal end of the feeding stalk away from the reflector plate and away from the first support part, and receives the radiating element to thereby support the radiating element.

20. The radiator of claim 19, wherein the feeding stalk includes first and second printed circuit board members arranged in a crossed manner, wherein the first and second printed circuit board members form four radially-extending legs, each of which has a step on an end facing away from the reflector plate, and wherein the radiating element is beared axially on the steps.

21. The radiator of claim 20, wherein at least one of the four legs has a hole for a snap-fit connection with the second support part.

22. The radiator of claim 19, wherein the radiating element includes dipoles arranged in a crossed manner, and wherein each of the dipoles has a pair of dipole arms.

23. A multi-band base station antenna, comprising:

an array of high-band radiators and an array of low-band radiators mounted to extend upwardly from a reflector plate, wherein at least one of the low band radiators is provided with a feeding stalk, a radiating element and a radiator support that includes a first support part and a second support part that are separate from each other, wherein the first support part extends for part of a height of the feeding stalk and bears radially the feeding stalk so as to prevent roll-over of the feeding stalk, and wherein the second support part is mounted adjacent a distal end of the feeding stalk away from the reflector plate, and receives the radiating element to thereby support the radiating element, and wherein a plurality of high-band radiators of the array of high-band radiators are provided adjacent a corresponding feeding stalk of one of the at least one low-band radiators.

* * * * *